US012000604B2

(12) United States Patent
Koyano

(10) Patent No.: US 12,000,604 B2
(45) Date of Patent: Jun. 4, 2024

(54) FAILURE DIAGNOSIS SYSTEM CONFIGURED TO DIAGNOSE A STATE OF AN AIR-CONDITIONING APPARATUS HAVING A REFRIGERANT CIRCUIT

(71) Applicant: Mitsubishi Electric Corporation, Tokyo (JP)

(72) Inventor: Takehiro Koyano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 836 days.

(21) Appl. No.: 17/040,657

(22) PCT Filed: May 14, 2018

(86) PCT No.: PCT/JP2018/018554
§ 371 (c)(1),
(2) Date: Sep. 23, 2020

(87) PCT Pub. No.: WO2019/220507
PCT Pub. Date: Nov. 21, 2019

(65) Prior Publication Data

US 2021/0018203 A1 Jan. 21, 2021

(51) Int. Cl.
*F24F 11/38* (2018.01)
*F24F 11/62* (2018.01)
*F25B 49/02* (2006.01)

(52) U.S. Cl.
CPC ..... *F24F 11/38* (2018.01); *F24F 11/62* (2018.01); *F25B 49/022* (2013.01); *F25B 49/027* (2013.01)

(58) Field of Classification Search
CPC .. F24F 11/38; F24F 11/62; F24F 11/52; F24F 2110/10; F24F 2110/12; F24F 2140/20;
(Continued)

(56) References Cited

U.S. PATENT DOCUMENTS 5,203,179 A * 4/1993 Powell ..... F25B 49/022 62/216
2009/0151369 A1* 6/2009 Lifson ..... G06F 11/30 62/157

(Continued)

FOREIGN PATENT DOCUMENTS

EP 1 731 857 A1 12/2006
JP 2006-090614 A 4/2006

(Continued)

OTHER PUBLICATIONS

International Search Report of the International Searching Authority dated Jul. 17, 2018 for the corresponding International application No. PCT/JP2018/018554 (and English translation).

(Continued)

*Primary Examiner* — Alicia M. Choi
(74) *Attorney, Agent, or Firm* — Posz Law Group, PLC

(57) ABSTRACT

A failure diagnosis system diagnoses the state of an air-conditioning apparatus having a refrigerant circuit in which refrigerant circulates. The failure diagnosis system has an abnormality diagnosis unit that performs normal-operation abnormality diagnosis for determining whether or not there is an abnormality in the air-conditioning apparatus by using state data and control data during normal operation of the air-conditioning apparatus. If the abnormality diagnosis unit determines that there is an abnormality, it changes a control value for an actuator of the air-conditioning apparatus and acquires state data and control data. Then, the abnormality diagnosis unit performs abnormality-cause identification diagnosis for identifying the cause of the abnormality in the air-conditioning apparatus by using the state data and the control data acquired before the change of the control value and the state data and the control data acquired after the change of the control value.

2 Claims, 8 Drawing Sheets

(58) Field of Classification Search
CPC ..... F24F 11/30; F24F 11/32; F25B 49/022; F25B 49/027; F25B 49/005; F25B 2313/0292; F25B 2313/0293; F25B 2313/0294; F25B 2313/0314; F25B 2313/0315; F25B 2700/21152; F25B 13/00; F25B 40/00; F25B 41/39
See application file for complete search history.

(56) References Cited

U.S. PATENT DOCUMENTS

2011/0137853 A1 6/2011 Mackay
2012/0185728 A1* 7/2012 Guo ..... F24F 11/38 714/E11.159
2013/0340457 A1* 12/2013 Keres ..... F04B 51/00 62/129
2015/0127165 A1 5/2015 Quam et al.
2016/0169572 A1* 6/2016 Noboa ..... F25B 13/00 62/115
2017/0089626 A1* 3/2017 Seo ..... F25B 1/10
2017/0370498 A1* 12/2017 Kawamura ..... H02P 29/024
2018/0010847 A1* 1/2018 Qi ..... F25B 49/005
2019/0086108 A1* 3/2019 Okita ..... F24F 11/46
2019/0264936 A1* 8/2019 Bailey ..... F24F 11/65
2019/0264939 A1* 8/2019 Atchison ..... F24F 11/64
2020/0025402 A1* 1/2020 Bell ..... G05D 23/1923
2020/0309434 A1* 10/2020 Walser ..... F25B 49/005
2022/0147949 A1* 5/2022 Gillette ..... H04L 67/10
2022/0268468 A1* 8/2022 Green ..... G05B 23/027

FOREIGN PATENT DOCUMENTS

JP 4550253 B2 9/2010
JP 2012-127625 A 7/2012

OTHER PUBLICATIONS

Examination Report dated Dec. 7, 2022 issued in corresponding IN Patent Application No. 202027041492.

* cited by examiner

FAILURE DIAGNOSIS SYSTEM CONFIGURED TO DIAGNOSE A STATE OF AN AIR-CONDITIONING APPARATUS HAVING A REFRIGERANT CIRCUIT

CROSS REFERENCE TO RELATED APPLICATION

This application is a U.S. national stage application of PCT/JP2018/018554 filed on May 14, 2018, the contents of which are incorporated herein by reference.

TECHNICAL FIELD

The present invention relates to failure diagnosis systems that diagnose failures and signs of failures of air-conditioning apparatuses.

BACKGROUND ART

Air-conditioning apparatuses that control the air environment of spaces, such as rooms, are widely used, and are essential for maintaining comfort in spaces. Thus, a failure of an air-conditioning apparatus directly leads to discomfort for a user or users. Moreover, a failure of an air-conditioning apparatus disposed in, for example, a server room or a refrigerated storeroom may possibly lead to critical business loss. Therefore, in addition to periodical maintenance of air-conditioning apparatuses, failure diagnosis for diagnosing failures and signs of failures of air-conditioning apparatuses is considered to be of great importance in recent years.

Methods used in the related art for diagnosing a failure of an air-conditioning apparatus include a method involving measuring the state of the refrigeration cycle during normal operation and a method involving measuring the state of the refrigeration cycle during failure diagnosis operation in which the control of actuators is fixed.

However, during normal operation, the control of the outside air temperature, the control of the indoor load, and the control of the actuators vary. Thus, in the method in the related art performed during normal operation, it is difficult to diagnose a failure with high accuracy. In contrast, the accuracy of failure diagnosis in the method performed during failure diagnosis operation is normally higher than that in the method performed during normal operation. However, in the method performed during failure diagnosis operation, the control of the actuators has to be fixed even when there is no abnormality in the air-conditioning apparatus. This may possibly lead to increased power consumption and reduced comfort in the space.

A known failure diagnosis system in the related art executes preliminary diagnosis for determining a possibility of a failure during normal operation and executes failure diagnosis by performing failure diagnosis operation if it is determined that there is a possibility of a failure in the preliminary diagnosis (for example, see Patent Literature 1).

CITATION LIST

Patent Literature

Patent Literature 1: Japanese Unexamined Patent Application Publication No. 2012-127625

SUMMARY OF INVENTION

Technical Problem

However, the preliminary diagnosis in the failure diagnosis system according to Patent Literature 1 is performed based on a small amount of data and is adjusted such that it is easily determined that there is a possibility of a failure. Specifically, because the accuracy of the preliminary diagnosis is low in the failure diagnosis system according to Patent Literature 1, the failure diagnosis operation is frequently performed, thus making it difficult to reduce the power consumption and to enhance the comfort in the space. In addition, since the data obtained in the preliminary diagnosis is not used in the failure diagnosis in the failure diagnosis system according to Patent Literature 1, the efficiency and the accuracy of the failure diagnosis cannot be increased.

The present invention has been made to solve the aforementioned problems, and an object thereof is to provide a failure diagnosis system that performs failure diagnosis with high accuracy and high efficiency without impairing comfort.

Solution to Problem

A failure diagnosis system according to an embodiment of the present invention is configured to diagnose a state of an air-conditioning apparatus in a refrigerant circuit in which a refrigerant circulates. The failure diagnosis system includes a state detection unit configured to detect a state of the refrigerant in the refrigerant circuit as state data, a controller configured to control an actuator of the air-conditioning apparatus, and an abnormality diagnosis unit configured to perform normal-operation abnormality diagnosis determining presence or absence of abnormality of the air-conditioning apparatus by using the state data and control data indicating a content of control by the controller during a normal operation of the air-conditioning apparatus. When determining that abnormality is present in the air-conditioning apparatus, the abnormality diagnosis unit is configured to change a control value of the actuator of the air-conditioning apparatus, acquire the state data and the control data, and perform abnormality-cause identification diagnosis identifying a cause of an abnormality of the air-conditioning apparatus by using the state data and the control data that are acquired before the change of the control value, and the state data and the control data that are acquired after the change of the control value.

Advantageous Effects of Invention

According to the embodiment of the present invention, if it is determined that there is an abnormality in the air-conditioning apparatus during normal operation based on the state data and the control data, the control value of the actuator is changed. Then, the cause of the abnormality in the air-conditioning apparatus is identified by using the data acquired before the change of the control value and the data acquired after the change of the control value. Thus, the accuracy for determining whether or not there is an abnormality can be enhanced, and the cause of the abnormality can be identified quickly and accurately, whereby the failure diagnosis can be performed with high accuracy and high efficiency without the comfort being impaired.

DESCRIPTION OF EMBODIMENTS

Embodiment 1

Figure 1:
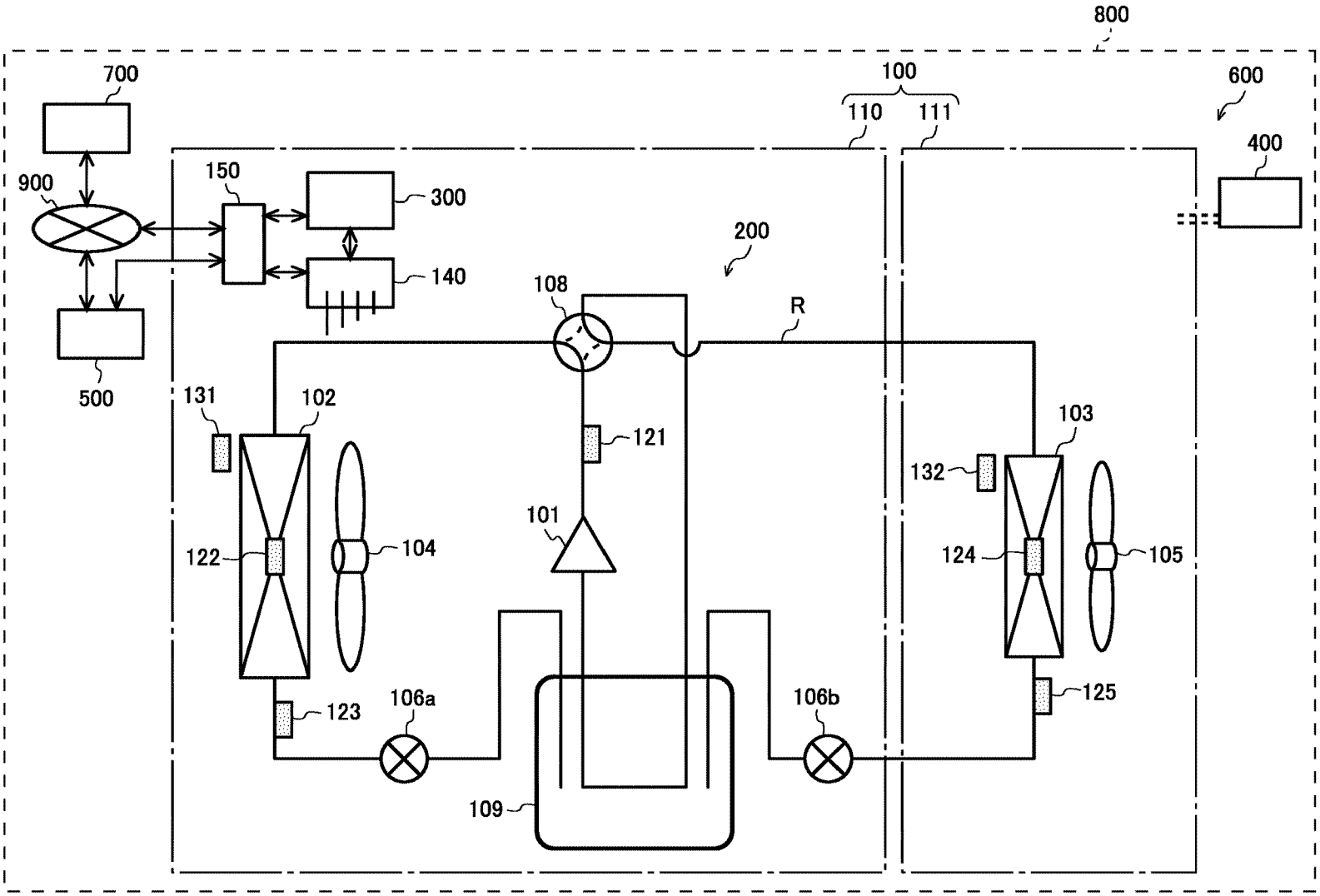
FIG. 1 illustrates the configuration of a failure diagnosis system according to Embodiment 1 of the present invention.

FIG. 1 illustrates the configuration of a failure diagnosis system according to Embodiment 1 of the present invention. As illustrated in FIG. 1, a failure diagnosis system 800 includes an air-conditioning system 600 and a server apparatus 700. The air-conditioning system 600 has an air-conditioning apparatus 100, a management apparatus 400, and an information terminal 500. The failure diagnosis system 800 diagnoses the state of the air-conditioning apparatus 100.

The air-conditioning apparatus 100 adjusts the air environment, including the temperature, humidity, and cleanliness of air in an air-conditioned space, such as a room. The air-conditioning apparatus 100 includes an outdoor unit 110 and an indoor unit 111. The outdoor unit 110 has a compressor 101, an outdoor heat exchanger 102, a first expansion valve 106*a*, a second expansion valve 106*b*, a four-way valve 108, and a receiver 109. The indoor unit 111 has an indoor heat exchanger 103. Specifically, the air-conditioning apparatus 100 includes a refrigerant circuit 200 in which the compressor 101, the outdoor heat exchanger 102, the first expansion valve 106*a*, the receiver 109, the second expansion valve 106*b*, and the indoor heat exchanger 103 are connected by a refrigerant pipe R and through which refrigerant circulates.

The outdoor unit 110 has an outdoor fan 104 that is attached to the outdoor heat exchanger 102 and that facilitates heat transfer of the outdoor heat exchanger 102. In Embodiment 1, the outdoor unit 110 has a controller 140, a communication device 150, and a failure diagnosis device 300. The indoor unit 111 has an indoor fan 105 that is attached to the indoor heat exchanger 103 and that facilitates heat transfer of the indoor heat exchanger 103.

Furthermore, the air-conditioning apparatus 100 has refrigerant temperature sensors 121 to 125 and air temperature sensors 131 and 132. The refrigerant temperature sensors 121 to 123 and the air temperature sensor 131 are provided in the outdoor unit 110, whereas the refrigerant temperature sensors 124 and 125 and the air temperature sensor 132 are provided in the indoor unit 111.

The compressor 101 is driven by, for example, an inverter, and compresses and discharges suctioned refrigerant. The outdoor heat exchanger 102 comprises, for example, a fin-and-tube heat exchanger and causes the air and the refrigerant to exchange heat with each other.

The four-way valve 108 is connected to the discharge side of the compressor 101, that is, the outlet of the compressor 101, via the refrigerant pipe R. The four-way valve 108 switches the flow path of the refrigerant in the refrigerant circuit 200. The connection direction of the four-way valve 108 is switched by the controller 140, so that the direction in which the refrigerant flows through the refrigerant circuit 200 is reversed.

During cooling operation in which cooling energy is supplied to the indoor unit 111, the connection direction of the four-way valve 108 is set as indicated by a solid line in FIG. 1. Therefore, the refrigerant during cooling operation circulates through the refrigerant circuit 200 in the following order: the compressor 101, the outdoor heat exchanger 102, the first expansion valve 106*a*, the receiver 109, the second expansion valve 106*b*, the indoor heat exchanger 103, and the compressor 101. In this case, the outdoor heat exchanger 102 functions as a condenser, whereas the indoor heat exchanger 103 functions as an evaporator.

During heating operation in which heating energy is supplied to the indoor unit 111, the connection direction of the four-way valve 108 is set as indicated by a dashed line in FIG. 1. Therefore, the refrigerant during heating operation circulates through the refrigerant circuit 200 in the following order: the compressor 101, the indoor heat exchanger 103, the second expansion valve 106*b*, the receiver 109, the first expansion valve 106*a*, the outdoor heat exchanger 102, and the compressor 101. In this case, the indoor heat exchanger 103 functions as a condenser, whereas the outdoor heat exchanger 102 functions as an evaporator.

The first expansion valve 106*a* and the second expansion valve 106*b* are, for example, electronic expansion valves and expand the refrigerant by reducing the pressure thereof. The first expansion valve 106*a* has one end connected to the outdoor heat exchanger 102 and the other end connected to the receiver 109. The second expansion valve 106*b* has one end connected to the receiver 109 and the other end connected to the indoor heat exchanger 103.

The receiver 109 temporarily retains liquid refrigerant. The receiver 109 is connected to the first expansion valve 106*a* and the second expansion valve 106*b* via the refrigerant pipe R. A part of the refrigerant pipe R that connects the inlet of the compressor 101 and the four-way valve 108 extends through the receiver 109. Therefore, the refrigerant flowing through the refrigerant pipe R in the receiver 109 exchanges heat with refrigerant surrounding the refrigerant pipe R in the receiver 109. The indoor heat exchanger 103 comprises, for example, a fin-and-tube heat exchanger and causes the air and the refrigerant to exchange heat with each other.

The refrigerant temperature sensor 121 is provided at the discharge side of the compressor 101 and measures the temperature of the refrigerant discharged from the compressor 101. The refrigerant temperature sensor 122 is provided in the outdoor heat exchanger 102 and measures the temperature of the refrigerant flowing through the outdoor heat exchanger 102 as an outdoor refrigerant temperature. The refrigerant temperature sensor 123 is provided at the refrigerant pipe R between the outdoor heat exchanger 102 and the first expansion valve 106*a* and measures the temperature of the refrigerant flowing between the outdoor heat exchanger 102 and the first expansion valve 106*a*. The refrigerant temperature sensor 124 is provided in the indoor heat exchanger 103 and measures the temperature of the refrigerant flowing through the indoor heat exchanger 103 as an indoor refrigerant temperature. The refrigerant temperature sensor 125 is provided at the refrigerant pipe R between the indoor heat exchanger 103 and the second expansion valve 106*b* and measures the temperature of the refrigerant flowing between the indoor heat exchanger 103 and the second expansion valve 106*b*. The air temperature sensor 131 measures the outside air temperature as the temperature of air that is to exchange heat with the refrigerant flowing through the outdoor heat exchanger 102. The air temperature sensor 132 measures the indoor temperature as the temperature of air that is to exchange heat with the refrigerant flowing through the indoor heat exchanger 103.

The controller 140 controls actuators, such as the compressor 101, the outdoor fan 104, the indoor fan 105, the first expansion valve 106*a*, and the second expansion valve 106*b*, based on outputs from the refrigerant temperature sensors 121 to 125 and the air temperature sensors 131 and 132. Specifically, in FIG. 1, the compressor 101, the outdoor fan 104, the indoor fan 105, the first expansion valve 106*a*, and the second expansion valve 106*b* are illustrated as the actuators of the air-conditioning apparatus 100.

The controller 140 obtains control values for the actuators of the air-conditioning apparatus 100 based on target temperature and humidity values for the air-conditioned space and measurement data obtained by the sensors, and controls the operation of the actuators so that the obtained control values are reached. Examples of the control values for the actuators of the air-conditioning apparatus 100 include the operating frequency of the compressor 101, the rotation speeds of the outdoor fan 104 and the indoor fan 105, and the opening degrees of the first expansion valve 106*a* and the second expansion valve 106*b*. Furthermore, the controller 140 outputs control data indicating the control contents for the actuators to a stable-operation determining unit 310 and the failure diagnosis device 300.

The communication device 150 serves as an interface when the controller 140 and the failure diagnosis device 300 communicate with an external device. When communicating with the server apparatus 700, the communication device 150 may be capable of communicating therewith via the information terminal 500. In this case, the communication device 150 communicates with the information terminal 500 in accordance with a near-field wireless communication method, such as WiFi (registered trademark, the same applies hereinafter) or Bluetooth (registered trademark, the same applies hereinafter). The information terminal 500 serves as a relay device that transmits and receives signals incoming to and outgoing from an electric communication line 900 serving as a network, such as the Internet, and communicates with the server apparatus 700 connected to the electric communication line 900.

The management apparatus 400 is connected to the controller 140 and the communication device 150 of the air-conditioning apparatus 100 in a wired or wireless manner, and manages the air-conditioning apparatus 100. The management of the air-conditioning apparatus 100 includes a process of receiving an operation performed on the air-conditioning apparatus 100 and transmitting the content of the received operation to the controller 140. Specifically, the management apparatus 400 is connected to the controller 140 in a communicable manner. The management apparatus 400 is also connected to the failure diagnosis device 300 and the information terminal 500 in a communicable manner via the communication device 150. In addition to a remote controller for operating the air-conditioning apparatus 100, an assumed example of the management apparatus 400 is a central management apparatus for managing one or more air-conditioning apparatuses 100. Specifically, the management apparatus 400 is used when a user operates the air-conditioning apparatus 100 or when a user ascertains the operating state of the air-conditioning apparatus 100.

The information terminal 500 is a communication terminal, such as a portable telephone, a smartphone, a tablet PC (personal computer), a notebook PC, or a desktop PC. The information terminal 500 is connected to the controller 140 and the failure diagnosis device 300 in a communicable manner via the communication device 150.

The server apparatus 700 comprises, for example, a storage processing apparatus provided outside the air-conditioning apparatus 100 and provided by a cloud service. Specifically, the server apparatus 700 is a cloud server based on cloud computing. The server apparatus 700 is connected to the information terminal 500 in a communicable manner via the electric communication line 900. Moreover, the server apparatus 700 is connected to the controller 140, the failure diagnosis device 300, and the management apparatus 400 in a communicable manner via the electric communication line 900 and the communication device 150. Alternatively, the server apparatus 700 may be a physical server, such as a web server.

Figure 2:
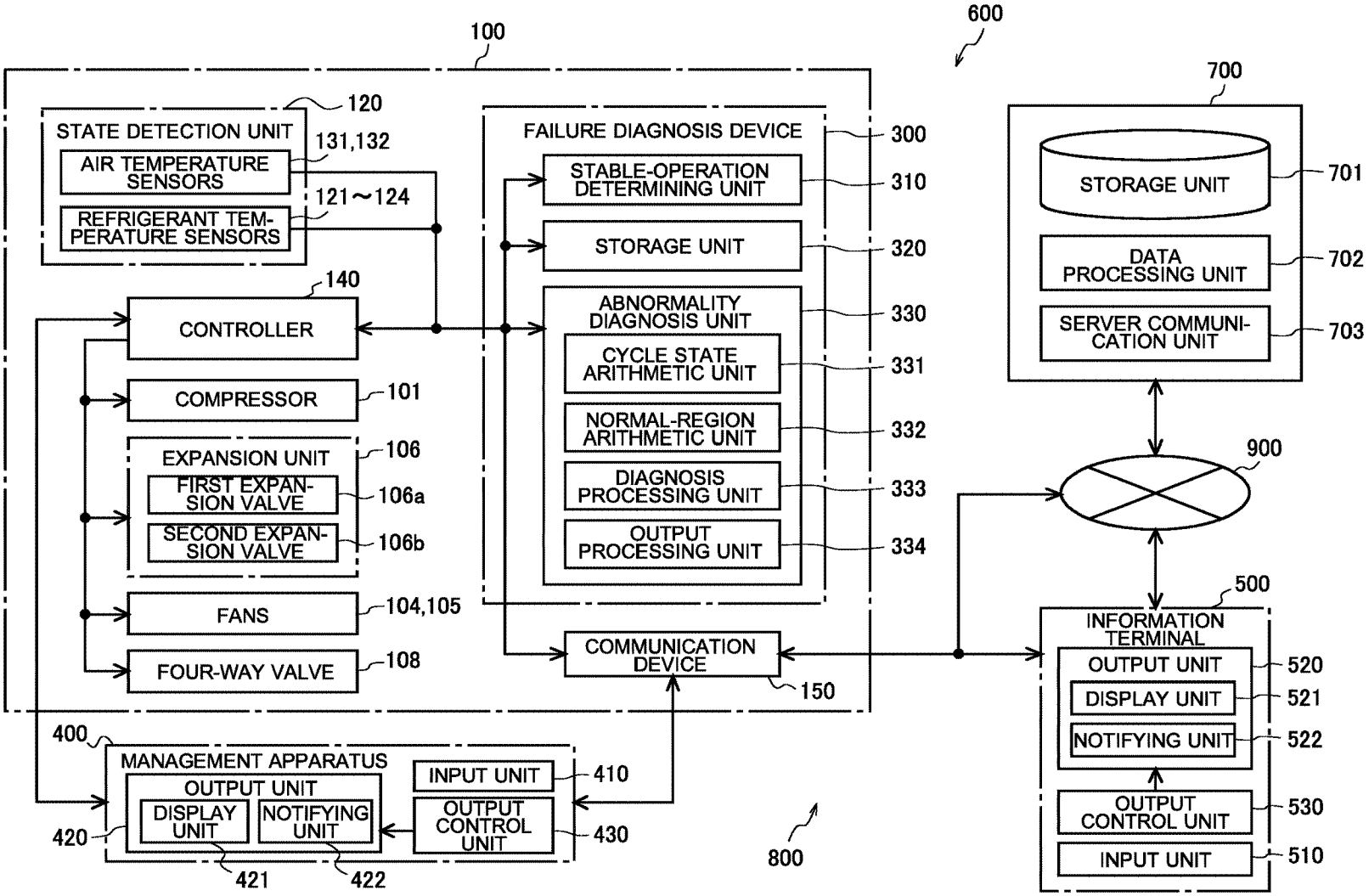
FIG. 2 is a block diagram illustrating a functional configuration of the failure diagnosis system in FIG. 1.
Figure 3:
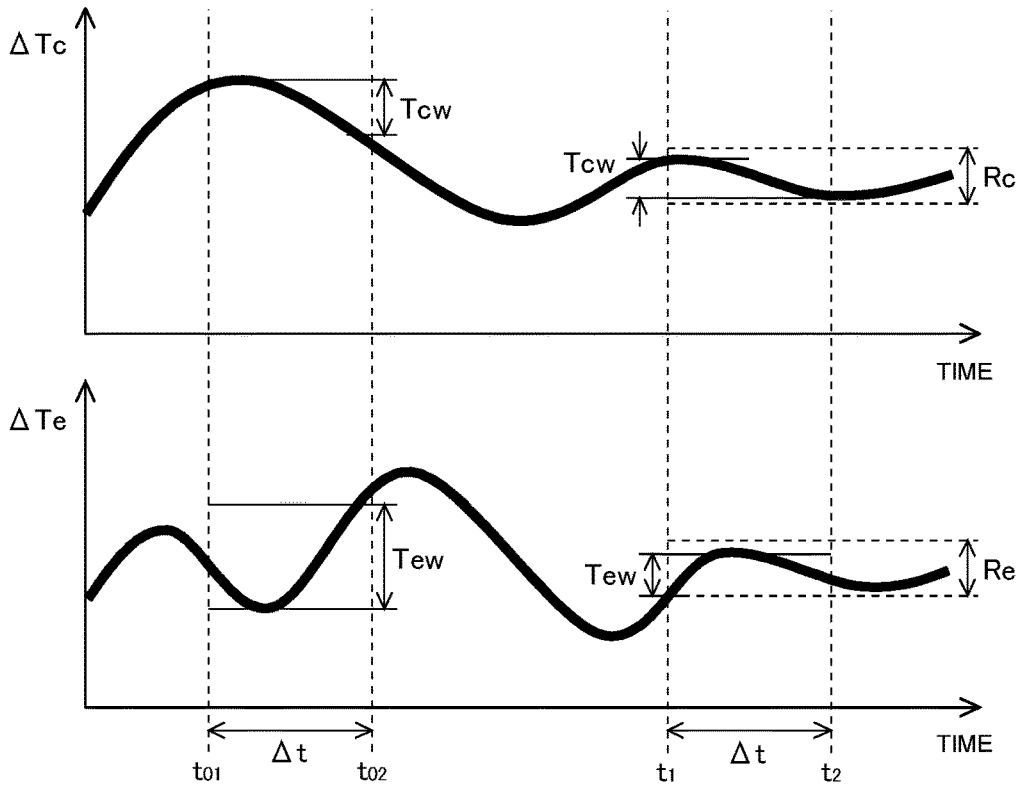
FIG. 3 is a graph for explaining an example of a determination process performed by a stable-operation determining unit in FIG. 2.
Figure 4:
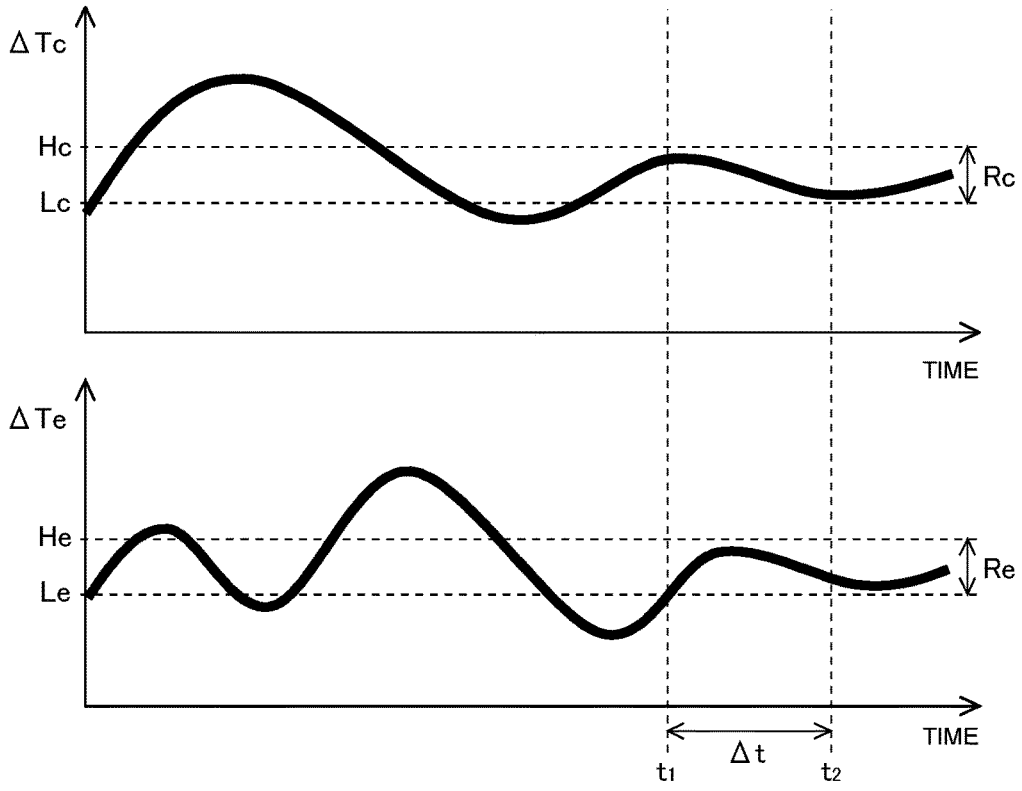
FIG. 4 is a graph for explaining another example of the determination process performed by the stable-operation determining unit in FIG. 2.

FIG. 2 is a block diagram illustrating a functional configuration of the failure diagnosis system in FIG. 1. FIG. 3 is a graph for explaining an example of a determination process performed by the stable-operation determining unit in FIG. 2. FIG. 4 is a graph for explaining another example of the determination process performed by the stable-operation determining unit in FIG. 2. The functional configuration of the failure diagnosis system 800 will be described with reference to FIGS. 2 to 4.

A state detection unit 120 detects the state of the refrigerant in the refrigerant circuit 200 as state data. In Embodiment 1, the state detection unit 120 includes the refrigerant temperature sensors 121 to 125 and the air temperature sensors 131 and 132, as illustrated in FIG. 2. An expansion unit 106 includes the first expansion valve 106*a* and the second expansion valve 106*b*.

The failure diagnosis device 300 diagnoses the state of the air-conditioning apparatus 100 by using the state data and the control data. The failure diagnosis device 300 has the stable-operation determining unit 310, a storage unit 320, and an abnormality diagnosis unit 330. Specifically, in Embodiment 1, the stable-operation determining unit 310, the storage unit 320, and the abnormality diagnosis unit 330 are disposed inside the air-conditioning apparatus 100.

The stable-operation determining unit 310 acquires various types of data included in signals sent from the controller 140, the refrigerant temperature sensors 121 to 125, and the air temperature sensors 131 and 132. Specifically, the stable-operation determining unit 310 acquires the control data from the controller 140. Moreover, the stable-operation determining unit 310 acquires the state data detected by the state detection unit 120. The stable-operation determining unit 310 may acquire the state data via the controller 140, or may acquire the state data directly from the state detection unit 120. Based on the control data and the state data, the stable-operation determining unit 310 determines whether or not the operating state during normal operation of the air-conditioning apparatus 100 to be diagnosed is stable. The process for determining whether or not the operating state during normal operation of the air-conditioning apparatus 100 is stable will be referred to as "stable-operation determination process" hereinafter.

The term "normal operation" refers to cooling operation or heating operation intended for air-conditioning the air-conditioned space. Specifically, the term "during normal operation" refers to a state where cooling operation or heating operation is being performed for the purpose of air-conditioning the air-conditioned space. In the case of normal operation, the controller 140 controls, for example, the operating frequency of the compressor 101 so that the temperature and the humidity of the air-conditioned space are brought closer to the target values. For example, defrosting operation performed for removing frost from the outdoor heat exchanger 102 and operation performed under failure-cause identification control for identifying the cause of a failure of the air-conditioning apparatus 100 are not included in normal operation.

In detail, for example, during cooling operation, the stable-operation determining unit 310 acquires the outdoor refrigerant temperature measured by the refrigerant temperature sensor 122 and the outside air temperature measured by the air temperature sensor 131. Then, the stable-operation determining unit 310 subtracts the outside air temperature from the outdoor refrigerant temperature to obtain a first temperature difference ΔTc. In other words, the first temperature difference ΔTc is a temperature difference between the temperature of the refrigerant in the outdoor heat exchanger 102 and the temperature of the air. Furthermore, the stable-operation determining unit 310 acquires the indoor temperature measured by the air temperature sensor 132 and the indoor refrigerant temperature measured by the refrigerant temperature sensor 124. Then, the stable-operation determining unit 310 subtracts the indoor refrigerant temperature from the indoor temperature to obtain a second temperature difference ΔTe. Specifically, the second temperature difference ΔTe is a temperature difference between the temperature of the refrigerant in the indoor heat exchanger 103 and the temperature of the air.

A first determination range Rc to be compared with the first temperature difference ΔTc and a second determination range Re to be compared with the second temperature difference ΔTe in the stable-operation determination process are stored in the storage unit 320. Moreover, a stability determination period Δt set in accordance with, for example, the specifications and the installation environment of the air-conditioning apparatus 100 is stored in the storage unit 320.

As illustrated in FIG. 3, the stable-operation determining unit 310 temporally analyzes variations in the first temperature difference ΔTc and the second temperature difference ΔTe in the stable determination period Δt. That is, the stable-operation determining unit 310 analyzes variations in the first temperature difference ΔTc and the second temperature difference ΔTe for every determination cycle set in accordance with, for example, a clock of a microcomputer. The determination cycle is set to be shorter than the stability determination period Δt, or may alternatively be set to be longer than the stability determination period Δt.

The stable-operation determining unit 310 determines whether or not a variation width Tcw of the first temperature difference ΔTc in the stability determination period Δt from the time point at which the analysis is started is within the first determination range Rc. Moreover, the stable-operation determining unit 310 determines whether or not a variation width Tew of the second temperature difference ΔTe in the stability determination period Δt from the time point at which the analysis is started is within the second determination range Re. Then, when a state where the first temperature difference ΔTc is within the first determination range Rc and the second temperature difference ΔTe is within the second determination range Re continues for the stability determination period Δt, the stable-operation determining unit 310 determines that the operating state of the air-conditioning apparatus 100 is stable.

In the example in FIG. 3, in the stability determination period Δt from a time point $t_{01}$ to a time point $t_{02}$, the variation width Tcw of the first temperature difference ΔTc is not within the first determination range Rc, and the variation width Tew of the second temperature difference ΔTe is not within the second determination range Re. Therefore, the stable-operation determining unit 310 determines that the operating state of the air-conditioning apparatus 100 is not stable at the time point $t_{02}$.

On the other hand, in the stability determination period Δt from a time point $t_1$ to a time point $t_2$, the variation width Tcw of the first temperature difference ΔTc is within the first determination range Rc, and the variation width Tew of the second temperature difference ΔTe is within the second determination range Re. Therefore, the stable-operation determining unit 310 determines that the operating state of the air-conditioning apparatus 100 is stable at the time point $t_2$.

Furthermore, as illustrated in FIG. 4, the first determination range Rc and the second determination range Re may individually be fixed regions set in accordance with, for example, the specifications and the installation environment of the air-conditioning apparatus 100. Specifically, an outdoor lower-limit threshold value Lc as a lower-limit temperature for the first determination range Rc and an outdoor upper-limit threshold value Hc as an upper-limit temperature for the first determination range Rc may be stored in the storage unit 320. Moreover, an indoor lower-limit threshold value Le as a lower-limit temperature for the second determination range Re and an indoor upper-limit threshold value He as an upper-limit temperature for the second determination range Re may be stored in the storage unit 320.

In the example in FIG. 4, during the stability determination period Δt from the time point $t_1$, the first temperature difference ΔTc is within the first determination range Rc, and the second temperature difference ΔTe is within the second determination range Re. Thus, the stable-operation determining unit 310 determines that the operating state of the air-conditioning apparatus 100 is stable at the time point $t_2$.

Alternatively, the stable-operation determining unit 310 may determine that the operating state of the air-conditioning apparatus 100 is stable when a state where the first temperature difference ΔTc is within the first determination range Rc continues for the stability determination period Δt, regardless of a change in the second temperature difference ΔTe. As another alternative, the stable-operation determining unit 310 may determine that the operating state of the air-conditioning apparatus 100 is stable when a state where the second temperature difference ΔTe is within the second determination range Re continues for the stability determination period Δt, regardless of the first temperature difference ΔTc. During heating operation, the stable-operation determining unit 310 determines whether or not the operating state of the air-conditioning apparatus 100 is stable in a manner similar to the above by using measurement data obtained by the sensors.

In addition, if the stable-operation determining unit 310 determines that the operating state of the air-conditioning apparatus 100 is stable in the stable-operation determination process during normal operation, the stable-operation determining unit 310 causes the storage unit 320 to store the control data and the state data at that time as operation data. The operating state of the air-conditioning apparatus 100 is indicated in the operation data. The stable-operation determining unit 310 may cause a storage unit 701 of the server apparatus 700 to store the operation data.

Based on the various types of data included in the signals sent from the controller 140, the refrigerant temperature sensors 121 to 125, and the air temperature sensors 131 and 132, the abnormality diagnosis unit 330 performs failure diagnosis of the air-conditioning apparatus 100 to be diagnosed. Specifically, during normal operation of the air-conditioning apparatus 100, the abnormality diagnosis unit 330 performs normal-operation abnormality diagnosis for determining whether or not there is an abnormality in the air-conditioning apparatus 100 based on the state data and the control data. Moreover, if the abnormality diagnosis unit 330 determines that there is an abnormality in the air-conditioning apparatus 100, the abnormality diagnosis unit 330 changes the control values for the actuators of the air-conditioning apparatus 100 and acquires state data and control data. Then, the abnormality diagnosis unit 330 performs abnormality-cause identification diagnosis for identifying the cause of the abnormality in the air-conditioning apparatus 100 by using the acquired state data and the acquired control data as well as the state data and the control data acquired before the change of the control values.

The abnormality diagnosis unit 330 performs the normal-operation abnormality diagnosis and the abnormality-cause identification diagnosis in a state space set in accordance with the refrigerant pressure and enthalpy. In Embodiment 1, the state space corresponds to a p-h diagram set in a coordinate plane having the refrigerant pressure and enthalpy as axes.

The abnormality diagnosis unit 330 determines whether or not there is an abnormality in the air-conditioning apparatus 100 by using the state data and the control data acquired when the operating state is determined as being stable by the stable-operation determining unit 310. The abnormality diagnosis unit 330 in Embodiment 1 acquires the state data and the control data acquired when the stable-operation determining unit 310 determines that the operating state of the air-conditioning apparatus 100 is stable. Then, the abnormality diagnosis unit 330 uses the acquired state data and the acquired control data to determine whether or not there is an abnormality in the air-conditioning apparatus 100.

In the normal-operation abnormality diagnosis, the abnormality diagnosis unit 330 uses the state data and the control data to obtain state space data indicating the state of the air-conditioning apparatus 100 in a state space. Moreover, in the abnormality-cause identification diagnosis, the abnormality diagnosis unit 330 uses the state data and the control data acquired after the change of the control values to obtain state space data. Then, the abnormality diagnosis unit 330 compares the state space data acquired after the change of the control values with the state space data obtained in the normal-operation abnormality diagnosis to identify the cause of the abnormality in the air-conditioning apparatus 100.

State space data contains refrigerant state information x and a normal region X. The refrigerant state information x is information indicating the state of the refrigerant at a specific location of the refrigerant circuit 200. The normal region X is information about a region where the refrigerant state information x exists during normal operation of the air-conditioning apparatus 100. Specifically, the normal region X is information about a region within a state space in which the refrigerant state information x exists when there is no abnormality in the air-conditioning apparatus 100, that is, when there is no abnormality in the actuators and the sensors.

In Embodiment 1, the abnormality diagnosis unit 330 compares the refrigerant state information x acquired after the change of the control values with the refrigerant state information x obtained in the normal-operation abnormality diagnosis to identify the cause of the abnormality in the air-conditioning apparatus 100. Examples of the cause of the abnormality in the air-conditioning apparatus 100 include an abnormal refrigerant amount, heat exchange deterioration, filter clogging, a compressor abnormality, a liquid-back phenomenon (abnormal compression of liquid refrigerant), overcurrent, pipe clogging, a locked LEV (locked expansion valve), and a locked fan.

An abnormal refrigerant amount refers to an insufficient or excessive amount of refrigerant in the refrigerant circuit 200. Heat exchange deterioration refers to an abnormality, such as deterioration, occurring in at least one of the outdoor heat exchanger 102 and the indoor heat exchanger 103. Filter clogging refers to a state where a filter provided at, for example, an air inlet of the air-conditioning apparatus 100 is clogged. A compressor abnormality refers to a state where an abnormality has occurred in the compressor 101. A liquid-back phenomenon refers to a state where liquid refrigerant is returning to the compressor 101. Overcurrent refers to excessive electric current flowing to the actuators of the air-conditioning apparatus 100. Pipe clogging refers to a state where the refrigerant pipe R is clogged such that the flow of the refrigerant is hindered. A locked LEV refers to a state where an abnormality has occurred in at least one of the first expansion valve **106*a* and the second expansion valve 106*b*. A locked fan refers to a state where an abnormality has occurred in at least one of the outdoor fan 104 and the indoor fan 105**.

More specifically, the abnormality diagnosis unit 330 has a cycle state arithmetic unit 331, a normal-region arithmetic unit 332, a diagnosis processing unit 333, and an output processing unit 334. The cycle state arithmetic unit 331 obtains the refrigerant state information x by using the operation data acquired from the state detection unit 120 and the controller 140, or by using the operation data stored in the storage unit 320. The refrigerant state information x is provided in accordance with the refrigerant pressure and enthalpy.

The normal-region arithmetic unit 332 obtains the normal region X by using the operation data acquired from the state detection unit 120 and the controller 140, or by using the operation data stored in the storage unit 320 or the storage unit 701. In the abnormality-cause identification diagnosis, the normal-region arithmetic unit 332 obtains the normal region X by using the state data and the control data acquired after the change of the control values. If a plurality of pieces of refrigerant state information x are to be obtained by the cycle state arithmetic unit 331, the normal-region arithmetic unit 332 obtains normal regions X individually corresponding to the plurality of pieces of refrigerant state information x.

The normal-region arithmetic unit 332 may obtain the normal region X by further using information about the design specifications of the air-conditioning apparatus 100. Accordingly, a more appropriate normal region X can be obtained, and the accuracy of information to be displayed on a display unit can be enhanced, thereby enhancing the accuracy of diagnosis by the user.

The diagnosis processing unit 333 determines whether or not the refrigerant state information x obtained by the cycle state arithmetic unit 331 in the normal-operation abnormality diagnosis is included in the normal region X obtained by the normal-region arithmetic unit 332. In Embodiment 1, the determination of whether or not the refrigerant state information x is included in the normal region X corresponds to determination of whether or not an abnormality has occurred in the air-conditioning apparatus 100.

In the abnormality-cause identification diagnosis, the diagnosis processing unit 333 compares the state space data obtained in the normal-operation abnormality diagnosis with the state space data acquired after the change of the control values to identify the cause of the abnormality in the air-conditioning apparatus 100. In Embodiment 1, the diagnosis processing unit 333 compares the refrigerant state information x obtained by the cycle state arithmetic unit 331 after the change of the control values with the refrigerant state information x obtained by the cycle state arithmetic unit 331 in the normal-operation abnormality diagnosis to identify the cause of the abnormality in the air-conditioning apparatus 100.

The output processing unit 334 causes the abnormality-cause identification result to be output to at least one of the management apparatus 400 and the information terminal 500. The output processing unit 334 transmits cause identification information indicating the abnormality-cause identification result to at least one of the management apparatus 400 and the information terminal 500.

Furthermore, the output processing unit 334 causes at least one of the management apparatus 400 and the information terminal 500 to display the refrigerant state information x obtained by the cycle state arithmetic unit 331 in the normal-operation abnormality diagnosis and the refrigerant state information x acquired after the change of the control values. Specifically, the output processing unit 334 generates display data for displaying the refrigerant state information x acquired before and after the change of the control values on the p-h diagram. Then, the output processing unit 334 transmits the generated display data to at least one of the management apparatus 400 and the information terminal 500 via the communication device 150.

The output processing unit 334 may cause at least one of the management apparatus 400 and the information terminal 500 to display the state space data acquired before the change of the control values and the state space data acquired after the change of the control values. In this case, the output processing unit 334 generates display data for displaying the refrigerant state information x and the normal region X acquired before and after the change of the control values on the p-h diagram.

In the storage unit 320, various types of data used for diagnosing the state of the air-conditioning apparatus 100 are stored together with an operation program of the failure diagnosis device 300. For example, information about one or more calculation coefficients included in an arithmetic expression used by the normal-region arithmetic unit 332 for calculating a normal region X is stored in the storage unit 320. In the storage unit 320, information about a predetermined initial calculation coefficient is stored at the time of, for example, product shipment.

The server apparatus 700 includes the storage unit 701, a data processing unit 702, and a server communication unit 703. The various types of data included in the signals sent from the controller 140, the refrigerant temperature sensors 121 to 125, and the air temperature sensors 131 and 132, the state space data, and the diagnosis result obtained by the abnormality diagnosis unit 330 for a past certain period are stored in the storage unit 701. The certain period in which the server apparatus 700 accumulates data is changeable, where appropriate.

As illustrated in FIG. 2, the management apparatus 400 has an input unit 410, an output unit 420, and an output control unit 430. The output unit 420 includes a display unit 421 and a notifying unit 422. The input unit 410 includes, for example, operation buttons and receives an operation performed by the user. Furthermore, the input unit 410 transmits an operation signal indicating the content of the operation performed by the user to the controller 140 or the failure diagnosis device 300. When the input unit 410 receives an operation for requesting the air-conditioning apparatus 100 to execute state diagnosis, the input unit 410 transmits a diagnosis request signal to the failure diagnosis device 300.

The display unit 421 comprises, for example, a liquid crystal display (LCD) and has a function for displaying the refrigerant state information x and the normal region X. The notifying unit 422 includes a loudspeaker and outputs a sound or speech. The output control unit 430 causes the display unit 421 to display a diagnosis image including the refrigerant state information x and the normal region X based on the display data transmitted from the failure diagnosis device 300. In the management apparatus 400, an image display program for displaying the diagnosis image based on the display data is installed.

When the display data is transmitted from the output processing unit 334, the output control unit 430 causes the display unit 421 to display a diagnosis image displaying the refrigerant state information x and the normal region X on the p-h diagram or a diagnosis image displaying the refrigerant state information x on the p-h diagram. Furthermore, when the cause identification information is transmitted from the output processing unit 334, the output control unit 430 causes at least one of the display unit 421 and the notifying unit 422 to output the abnormality-cause identification result obtained by the diagnosis processing unit 333.

The information terminal 500 has an input unit 510, an output unit 520, and an output control unit 530. The output unit 520 includes a display unit 521 and a notifying unit 522. The input unit 510 includes, for example, operation buttons and receives an operation performed by the user. Furthermore, the input unit 510 transmits an operation signal indicating the content of the operation performed by the user to the failure diagnosis device 300. When the input unit 510 receives an operation for requesting the air-conditioning apparatus 100 to execute state diagnosis, the input unit 510 transmits a diagnosis request signal to the failure diagnosis device 300.

The display unit 521 comprises, for example, a liquid crystal display and has a function for displaying the refrigerant state information x and the normal region X. The notifying unit 522 includes a loudspeaker and outputs a sound or speech. The output control unit 530 causes the display unit 521 to display a diagnosis image including the refrigerant state information x and the normal region X based on the display data transmitted from the failure diagnosis device 300. In the information terminal 500, an image display program for displaying the diagnosis image based on the display data is installed.

When the display data is transmitted from the output processing unit 334, the output control unit 530 causes the display unit 521 to display a diagnosis image displaying the refrigerant state information x and the normal region X on the p-h diagram or a diagnosis image displaying the refrigerant state information x on the p-h diagram. Furthermore, when the cause identification information is transmitted from the output processing unit 334, the output control unit 530 causes at least one of the display unit 521 and the notifying unit 522 to output the abnormality-cause identification result obtained by the diagnosis processing unit 333.

The server apparatus 700 serves as a database that stores and accumulates various types of data, such as data of a failure diagnosis result obtained from a process performed by the abnormality diagnosis unit 330. Furthermore, the server apparatus 700 has a function for performing various arithmetic processes based on the stored data.

The server apparatus 700 includes the storage unit 701, the data processing unit 702, and a server communication unit 703. The server communication unit 703 serves as an interface when a device, such as the data processing unit 702, in the server apparatus 700 is to communicate with an external device via the electric communication line 900, and performs, for example, signal conversion. The storage unit 701 stores therein, for example, state data, control data, and a diagnosis result obtained by the abnormality diagnosis unit 330 as data. The data processing unit 702 communicates with an external device via the server communication unit 703 and causes the storage unit 701 to store data acquired from the external device.

The data processing unit 702 may calculate a calculation coefficient used for calculating a normal region X from the state data, the control data, and the data of the diagnosis result from the failure diagnosis device 300, and may periodically update the calculation coefficient. Specifically, the data processing unit 702 may periodically calculate the calculation coefficient and transmit the calculated calculation coefficient to the failure diagnosis device 300. Then, the failure diagnosis device 300 may renew the calculation coefficient in the storage unit 320 to the calculation coefficient transmitted from the data processing unit 702.

Figure 5:
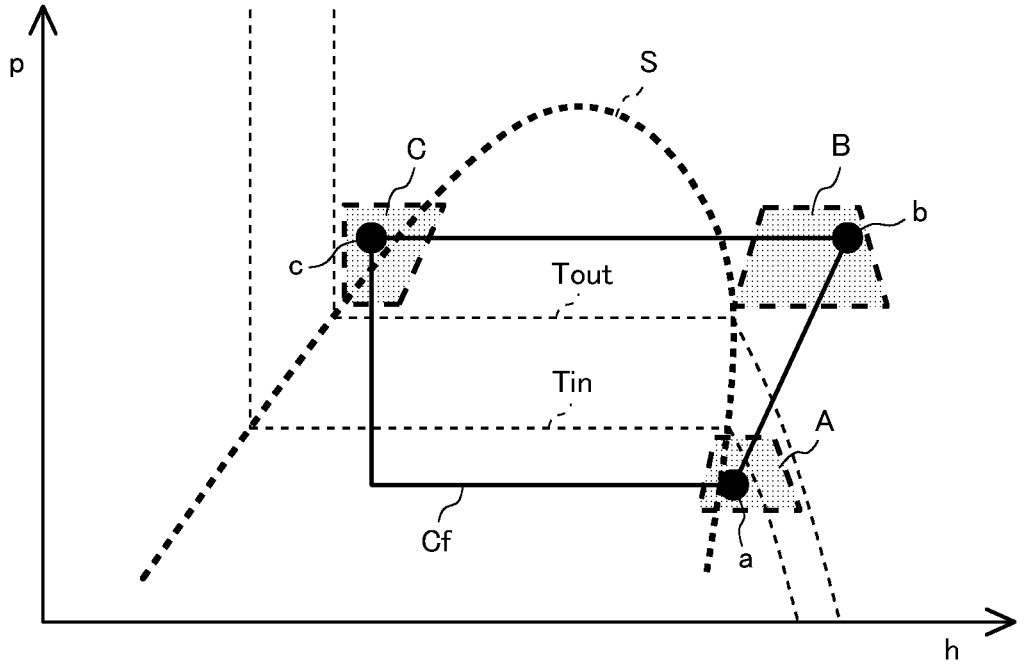
FIG. 5 illustrates a case where an air-conditioning apparatus is in a normal state in a display example of refrigerant state information and normal regions in Embodiment 1 of the present invention.

FIG. 5 illustrates a case where the air-conditioning apparatus is in a normal state in a display example of refrigerant state information and normal regions in Embodiment 1 of the present invention. In FIG. 5, a diagnosis image displaying refrigerant state information x and normal regions X on a p-h diagram is illustrated. In FIG. 5, a saturation line S including a saturated liquid line and a saturated vapor line, a refrigeration cycle pattern Cf, an isothermal line Tout corresponding to the outdoor temperature, and an isothermal line Tin corresponding to the indoor temperature are illustrated.

In the example in FIG. 5, the cycle state arithmetic unit 331 calculates refrigerant state information x for each of three specific locations in the refrigerant circuit 200, and the normal-region arithmetic unit 332 calculates a normal region X corresponding to each of the three pieces of refrigerant state information x. The three pieces of refrigerant state information x are set in accordance with the state of the refrigerant at the three specific locations in the refrigerant circuit 200, respectively.

In the example in FIG. 5, the three specific locations are the inlet of the compressor 101, the outlet of the compressor 101, and the outlet of a condenser. Therefore, the three pieces of refrigerant state information x include inlet information a indicating the state of the refrigerant at the inlet of the compressor 101, outlet information b indicating the state of the refrigerant at the outlet of the compressor 101, and condenser information c indicating the state of the refrigerant at the outlet of the condenser. Specifically, the normal-region arithmetic unit 332 calculates the inlet information a, the outlet information b, and the condenser information c as the three pieces of refrigerant state information x.

In the example in FIG. 5, three normal regions X are set in accordance with the inlet information a, the outlet information b, and the condenser information c as the three pieces of refrigerant state information x, respectively. Therefore, the three normal regions X include an inlet region A where the inlet information a exists during normal operation, an outlet region B where the outlet information b exists during normal operation, and a condenser region C where the condenser information c exists during normal operation. Specifically, the cycle state arithmetic unit 331 calculates the inlet region A, the outlet region B, and the condenser region C as the three normal regions X respectively corresponding to the three pieces of refrigerant state information x.

For example, in the diagnosis image in FIG. 5, it is determined that there is no abnormality in the air-conditioning apparatus 100 since the refrigerant state information x is within each normal region X. On the other hand, in a case where the condenser information c has higher enthalpy than the condenser region C, the condenser information c deviates rightward relative to the condenser region C. In this case, an abnormal refrigerant amount in the refrigerant circuit 200 is suspected.

In a case where the outlet information b has higher pressure than the outlet region B and the condenser information c has higher pressure than the condenser region C, the outlet information b deviates upward relative to the outlet region B and the condenser information c deviates upward relative to the condenser region C in the diagnosis image. In this case, a heat transfer abnormality in a condenser is suspected. An assumed cause of a heat transfer abnormality in a condenser may be an abnormality in the outdoor heat exchanger 102 or an operational abnormality in the outdoor fan 104 during cooling operation, or may be an abnormality in the indoor heat exchanger 103 or an operational abnormality in the indoor fan 105 during heating operation.

In a case where the inlet information a has lower pressure than the inlet region A, the inlet information a deviates downward relative to the inlet region A in the diagnosis image. In this case, a heat transfer abnormality in an evaporator is suspected. An assumed cause of a heat transfer abnormality in an evaporator may be an abnormality in the indoor heat exchanger 103 or an operational abnormality in the indoor fan 105 during cooling operation, or may be an abnormality in the outdoor heat exchanger 102 or an operational abnormality in the outdoor fan 104 during heating operation.

In a case where the outlet information b has higher enthalpy than the outlet region B, the outlet information b deviates rightward relative to the outlet region B in the diagnosis image. In this case, an abnormality in the compressor 101 is suspected. In a case where the inlet information a has lower enthalpy than the inlet region A, the inlet information a deviates leftward relative to the inlet region A in the diagnosis image. In this case, a state where liquid refrigerant is flowing into the compressor 101 is suspected.

In a case where the inlet information a has higher pressure than the inlet region A, the outlet information b has lower pressure than the outlet region B, and the condenser information c has lower pressure than the condenser region C, the inlet information a deviates upward relative to the inlet region A, the outlet information b deviates downward relative to the outlet region B, and the condenser information c deviates downward relative to the condenser region C in the diagnosis image. In this case, an abnormality in the expansion unit 106 or pipe clogging is suspected. An abnormality in the expansion unit 106 refers to an abnormality occurring in at least one of the first expansion valve 106*a* and the second expansion valve 106*b*. Pipe clogging refers to a situation where there is a blocked section hindering the circulation of the refrigerant in the refrigerant circuit 200.

In the normal-operation abnormality diagnosis, the abnormality diagnosis unit 330 may obtain the refrigerant state information x by using the state data and the control data, and may cause the storage unit 701 of the server apparatus 700 to arrange and accumulate the obtained refrigerant state information x in a chronological order. Then, the abnormality diagnosis unit 330 may determine whether or not there is an abnormality in the air-conditioning apparatus 100 based on a temporal change in the refrigerant state information x accumulated in the server apparatus 700. Accordingly, the tendency of aged deterioration in, for example, the actuators of the air-conditioning apparatus 100 can be ascertained, so that the air-conditioning apparatus 100 can be monitored with higher accuracy, whereby appropriate measures can be taken more quickly in accordance with the state of the air-conditioning apparatus 100.

The failure diagnosis system 800 includes the server apparatus 700 and the single air-conditioning system 600 in FIGS. 1 and 2, but is not limited to this configuration. The failure diagnosis system 800 may include the server apparatus 700 and a plurality of air-conditioning systems 600. In this case, each of the plurality of air-conditioning systems 600 may accumulate, over time, the state data, the control data, the data obtained in the normal-operation abnormality diagnosis, and the data obtained in the abnormality-cause identification diagnosis in the server apparatus 700. Then, the plurality of air-conditioning systems 600 may use the information accumulated in the server apparatus 700 in a shared manner. Accordingly, the abnormality diagnosis unit 330 can perform failure diagnosis by using not only the past data accumulated in the storage unit 701 but also data of another air-conditioning system 600, so that the diagnosis accuracy can be enhanced.

For example, to suppress an increased frequency of performing abnormality determination, the normal region X is set to a relatively large region in an initial stage where the accumulated amount of data is small. However, by using the data accumulated in the server apparatus 700, the normal region X can be reduced to an appropriate region at a relatively early stage. Therefore, the diagnosis accuracy of the normal-operation abnormality diagnosis can be enhanced.

As an alternative to the diagnosis image displayed in FIG. 5 that includes the saturation line S, the diagnosis image does not have to include the saturation line S. Furthermore, as an alternative to the diagnosis image displayed in FIG. 5 that includes the refrigeration cycle pattern Cf, the diagnosis image does not have to include the refrigeration cycle pattern Cf. However, the diagnosis image including the refrigeration cycle pattern Cf facilitates the correspondence between the refrigerant state information x and the normal region X, thereby achieving enhanced user-friendliness.

In addition, as an alternative to the diagnosis image in FIG. 5 having the isothermal line Tout and the isothermal line Tin displayed therein, the isothermal line Tout and the isothermal line Tin do not have to be displayed in the diagnosis image. However, with the diagnosis image having the isothermal line Tout and the isothermal line Tin displayed therein, the user can visually ascertain the relationship between the state of the air-conditioning apparatus 100 and the air temperature around the air-conditioning apparatus 100.

The controller 140 and the failure diagnosis device 300 may each be hardware, such as a circuit device that realizes the above-described functions, or may each include an arithmetic device, such as a microcomputer, and software that realizes the above-described functions by operating in cooperation with such an arithmetic device. The storage unit 320 may be, for example, a RAM (random access memory) and a ROM (read only memory), a PROM (programmable ROM), such as a flash memory, or an HDD (hard disk drive).

Figure 6:
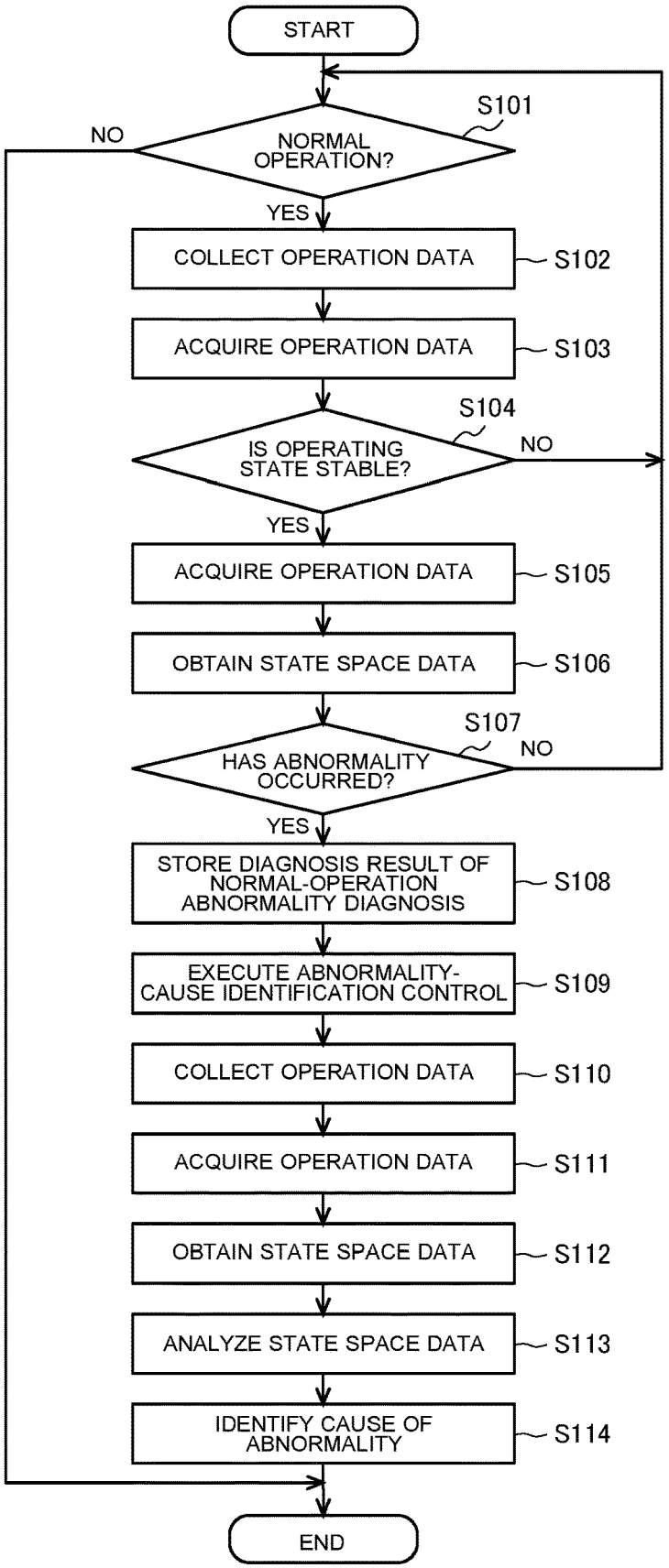
FIG. 6 is a flowchart illustrating the operation performed by the failure diagnosis system in FIGS. 1 and 2.

FIG. 6 is a flowchart illustrating the operation performed by the failure diagnosis system in FIGS. 1 and 2. A failure diagnosis method of the air-conditioning apparatus 100 according to Embodiment 1 will be described with reference to FIG. 6.

First, the controller 140 determines whether or not the air-conditioning apparatus 100 is performing normal operation (step S101). If the controller 140 determines that the air-conditioning apparatus 100 is not performing normal operation (step S101/No), the failure diagnosis process by the failure diagnosis system 800 is terminated.

If the controller 140 determines that the air-conditioning apparatus 100 is performing normal operation (step S101/Yes), the controller 140 collects current control data and current state data, that is, current operation data. Then, the controller 140 transmits the collected operation data to the stable-operation determining unit 310 (step S102).

The stable-operation determining unit 310 acquires the current operation data from the controller 140 and causes the storage unit 320 to store the acquired operation data (step S103). Then, the stable-operation determining unit 310 determines whether or not the operating state of the air-conditioning apparatus 100 is stable by using the current operation data (step S104). If the stable-operation determining unit 310 determines that the operating state of the air-conditioning apparatus 100 is not stable (step S104/No), the failure diagnosis system 800 proceeds to step S101. Specifically, the failure diagnosis system 800 waits until the operating state of the air-conditioning apparatus 100 becomes stable.

If the operating state of the air-conditioning apparatus 100 is stable (step S104/Yes), the stable-operation determining unit 310 transmits a stability signal indicating that the operating state of the air-conditioning apparatus 100 is stable to the abnormality diagnosis unit 330. Then, the abnormality diagnosis unit 330 acquires, from the storage unit 320, the current operation data collected by the controller 140 in step S102. Alternatively, the stable-operation determining unit 310 may transit a stability signal containing the current operation data to the abnormality diagnosis unit 330 (step S105).

The abnormality diagnosis unit 330 uses the current operation data to obtain state space data containing refrigerant state information x and a normal region X (step S106). Subsequently, the abnormality diagnosis unit 330 determines whether or not an abnormality has occurred in the air-conditioning apparatus 100 from the position of the refrigerant state information x relative to the normal region X (step S107). If the refrigerant state information x is included in the normal region X, the abnormality diagnosis unit 330 determines that an abnormality has not occurred in the air-conditioning apparatus 100 (step S107/No). In this case, the failure diagnosis system 800 proceeds to step S101. The failure diagnosis system 800 may proceed to step S101 after waiting for a predetermined waiting period.

On the other hand, if the refrigerant state information x has deviated from the normal region X, the abnormality diagnosis unit 330 determines that an abnormality has occurred in the air-conditioning apparatus 100. When the state space data contains a plurality of pieces of refrigerant state information x and a plurality of normal regions X, the abnormality diagnosis unit 330 determines that an abnormality has occurred in the air-conditioning apparatus 100 if at least one of the pieces of refrigerant state information x is outside the corresponding normal region X (step S107/Yes).

The series of steps from step S101 to step S107 corresponds to normal-operation abnormality diagnosis. The abnormality diagnosis unit 330 causes the storage unit 320 or the storage unit 701 to store the data obtained in the normal-operation abnormality diagnosis, that is, the operation data and the state space data (step S108).

Then, the abnormality diagnosis unit 330 executes abnormality-cause identification control for changing the control values for the actuators of the air-conditioning apparatus 100 from the current values. The abnormality-cause identification control is control for changing the control values for the actuators of the air-conditioning apparatus 100 and is intended for changing the state of the refrigeration cycle indicated in a p-h diagram. Specifically, the abnormality diagnosis unit 330 determines an actuator for which the control value is to be changed in accordance with the result of the normal-operation abnormality diagnosis. Then, the abnormality diagnosis unit 330 changes the control value for the determined actuator.

In more detail, the abnormality diagnosis unit 330 transmits, to the controller 140, a control command for the actuator determined based on the result of the normal-operation abnormality diagnosis. The controller 140 changes the control value for the actuator of the air-conditioning apparatus 100 by a preset amount in accordance with the control command from the abnormality diagnosis unit 330. For example, a preset amount for each actuator may be stored in the storage unit 320. In this case, the controller 140 may read the preset amount from the storage unit 320 and control the actuator. Alternatively, the abnormality diagnosis unit 330 may read the preset amount from the storage unit 320 and transmit a control command containing the read preset amount to the controller 140. Moreover, a preset amount table in which the control value and the preset amount are associated with each other for each actuator may be stored in the storage unit 320. In this case, the controller 140 obtains the preset amount by checking the current control value against the preset amount table. Alternatively, a control value table in which the control value for each actuator and a change value as a control value after the change are associated with each other may be stored in the storage unit 320. In this case, the controller 140 obtains the change value by checking the current control value against the control value table, and sets the control value for the actuator of the air-conditioning apparatus 100 to the change value (step S109).

Subsequently, the controller 140 collects the current control data and the current state data, that is, the operation data acquired after the change of the control value. This is for evaluating the effect that the failure-cause identification control has on the state of the refrigeration cycle. Then, the controller 140 transmits the operation data acquired after the change of the control value to the abnormality diagnosis unit 330 (step S110).

When the abnormality diagnosis unit 330 acquires the operation data after the change of the control value from the controller 140 (step S111), the abnormality diagnosis unit 330 uses the acquired operation data to obtain state space data after the change of the control value. Specifically, the abnormality diagnosis unit 330 calculates the state of the refrigeration cycle under the abnormality-cause identification control (step S112).

Then, the abnormality diagnosis unit 330 analyzes the state space data acquired after the change of the control value. Specifically, the abnormality diagnosis unit 330 compares the state space data obtained in step S106 with the state space data acquired after the change of the control value (step S113). Then, the abnormality diagnosis unit 330 identifies the cause of the abnormality in the air-conditioning apparatus 100 based on the degree of change in the state space data acquired after the change of the control value relative to the state space data obtained in step S106.

In this case, when the output processing unit 334 transmits cause identification information to the management apparatus 400, the management apparatus 400 causes at least one of the display unit 421 and the notifying unit 422 to output an abnormality-cause identification result. When the output processing unit 334 transmits the cause identification information to the information terminal 500, the information terminal 500 causes at least one of the display unit 521 and the notifying unit 522 to output the abnormality-cause identification result.

Furthermore, when the output processing unit 334 transmits display data to the management apparatus 400, the management apparatus 400 causes the display unit 421 to display an analysis image based on the display data. When the output processing unit 334 transmits the display data to the information terminal 500, the information terminal 500 causes the display unit 521 to display the analysis image based on the display data. The failure diagnosis system 800 can support the user, such as a maintenance person, by displaying the analysis image (step S114).

The series of steps from step S109 to step S114 corresponds to abnormality-cause identification diagnosis. As mentioned above, examples of the cause of the abnormality identified by the failure diagnosis system 800 include an abnormal refrigerant amount, heat exchange deterioration, filter clogging, a compressor abnormality, a liquid-back phenomenon, overcurrent, pipe clogging, a locked LEV, and a locked fan. The failure diagnosis system 800 executes the above-described series of steps from step S101 to step S114 for every predetermined diagnosis cycle.

A specific example of an abnormality-cause identification process performed by the abnormality diagnosis unit 330 will now be described. For example, in the normal-operation abnormality diagnosis, a diagnosis result indicating that an abnormality has occurred in at least one of the outdoor heat exchanger 102 and the outdoor fan 104 can be obtained. However, in the normal-operation abnormality diagnosis, it is not possible to determine in which one of the outdoor heat exchanger 102 and the outdoor fan 104 the abnormality has occurred.

Therefore, if a diagnosis result indicating that an abnormality has occurred in at least one of the outdoor heat exchanger 102 and the outdoor fan 104 is obtained in the normal-operation abnormality diagnosis, the abnormality diagnosis unit 330 performs control for changing the rotation speed of the outdoor fan 104 as the abnormality-cause identification control. In this case, if there is no abnormality in the outdoor fan 104, a predetermined change occurs in the p-h diagram when the rotation speed of the outdoor fan 104 is changed. Thus, the diagnosis processing unit 333 determines in which one of the outdoor heat exchanger 102 and the outdoor fan 104 the abnormality has occurred based on a response in the p-h diagram when the rotation speed of the outdoor fan 104 is changed. The diagnosis processing unit 333 according to Embodiment 1 identifies an actuator in which an abnormality has occurred based on a variation in the refrigerant state information x acquired after the change of the control value relative to the refrigerant state information x acquired before the change of the control value.

Accordingly, if the failure diagnosis system 800 determines that there is an abnormality in the air-conditioning apparatus 100 during normal operation based on the state data and the control data, the failure diagnosis system 800 changes the control value for an actuator. Then, the cause of the abnormality in the air-conditioning apparatus 100 is identified by using the operation data acquired before the change of the control value and the operation data acquired after the change of the control value. Accordingly, the accuracy for determining whether or not there is an abnormality can be enhanced, and the cause of the abnormality can be identified quickly and accurately, whereby the failure diagnosis can be performed with high accuracy and high efficiency without the comfort being impaired.

Furthermore, the failure diagnosis system 800 has the stable-operation determining unit 310 that determines whether or not the operating state of the air-conditioning apparatus 100 is stable by using the operation data during normal operation of the air-conditioning apparatus. The abnormality diagnosis unit 330 performs the normal-operation abnormality diagnosis when the stable-operation determining unit 310 determines that the operating state is stable. Specifically, in the normal-operation abnormality diagnosis, the accuracy for determining whether or not there is an abnormality is enhanced since the stability of the operating state of the air-conditioning apparatus 100 is ensured, thereby suppressing an increased frequency of performing the abnormality-cause identification control and saving energy.

Furthermore, in the normal-operation abnormality diagnosis, the abnormality diagnosis unit 330 uses the operation data to obtain the refrigerant state information x indicating the state of the refrigerant at specific locations in the refrigerant circuit 200. Moreover, in the abnormality-cause identification diagnosis, the abnormality diagnosis unit 330 uses the operation data acquired after the change of the control value to obtain the refrigerant state information x. Then, the abnormality diagnosis unit 330 compares the refrigerant state information x acquired before the change of the control value with the refrigerant state information x acquired after the change of the control value to identify the cause of the abnormality in the air-conditioning apparatus 100.

Then, the abnormality diagnosis unit 330 causes at least one of the management apparatus 400 and the information terminal 500 to output the abnormality-cause identification result. Therefore, the user, such as a maintenance person, can ascertain the cause of the abnormality in the air-conditioning apparatus 100 quickly and effortlessly. Moreover, the abnormality diagnosis unit 330 causes at least one of the management apparatus 400 and the information terminal 500 to display the refrigerant state information x acquired before the change of the control value and the refrigerant state information x acquired after the change of the control value. Thus, the user, such as a maintenance person, can ascertain the state of the air-conditioning apparatus 100 at a glance. In addition, in a case where the abnormality diagnosis unit 330 causes the refrigerant state information x acquired before and after the change of the control value to be output together with the abnormality-cause identification result, the user can visually recognize not only the abnormality-cause identification result but also the degree of the abnormality, so that more detailed measures can be taken.

Embodiment 2

Since the overall configuration and the functional configuration of a failure diagnosis system according to Embodiment 2 of the present invention are similar to those in Embodiment 1, identical components will be given the same reference signs, and descriptions thereof will be omitted. In Embodiment 2, the failure diagnosis device 300 is configured assuming that a maintenance person uses the failure diagnosis system 800 by being commissioned by a client.

The stable-operation determining unit 310 according to Embodiment 2 determines whether or not the operating state of the air-conditioning apparatus 100 is stable for every predetermined updating cycle. The stable-operation determining unit 310 causes the storage unit 320 to store state data and control data, that is, operation data, when the operating state of the air-conditioning apparatus 100 is determined as being stable by the stable-operation determining unit 310. The operation data that the stable-operation determining unit 310 causes the storage unit 320 to store when the operating state of the air-conditioning apparatus 100 is stable may also be referred to as stable operation data hereinafter. If the stable-operation determining unit 310 determines that the operating state of the air-conditioning apparatus 100 is stable in the determination performed for every updating cycle, the stable-operation determining unit 310 may write new stable operation data over the stable operation data in the storage unit 320.

The abnormality diagnosis unit 330 according to Embodiment 2 reads the latest stable operation data from the storage unit 320 in response to a diagnosis request from the outside, and uses the read stable operation data to determine whether or not there is an abnormality in the air-conditioning apparatus 100. Furthermore, when the abnormality diagnosis unit 330 determines that there is an abnormality in the air-conditioning apparatus 100 in normal-operation abnormality diagnosis and also receives a cause identification request from the outside, the abnormality diagnosis unit 330 performs abnormality-cause identification diagnosis.

Figure 7:
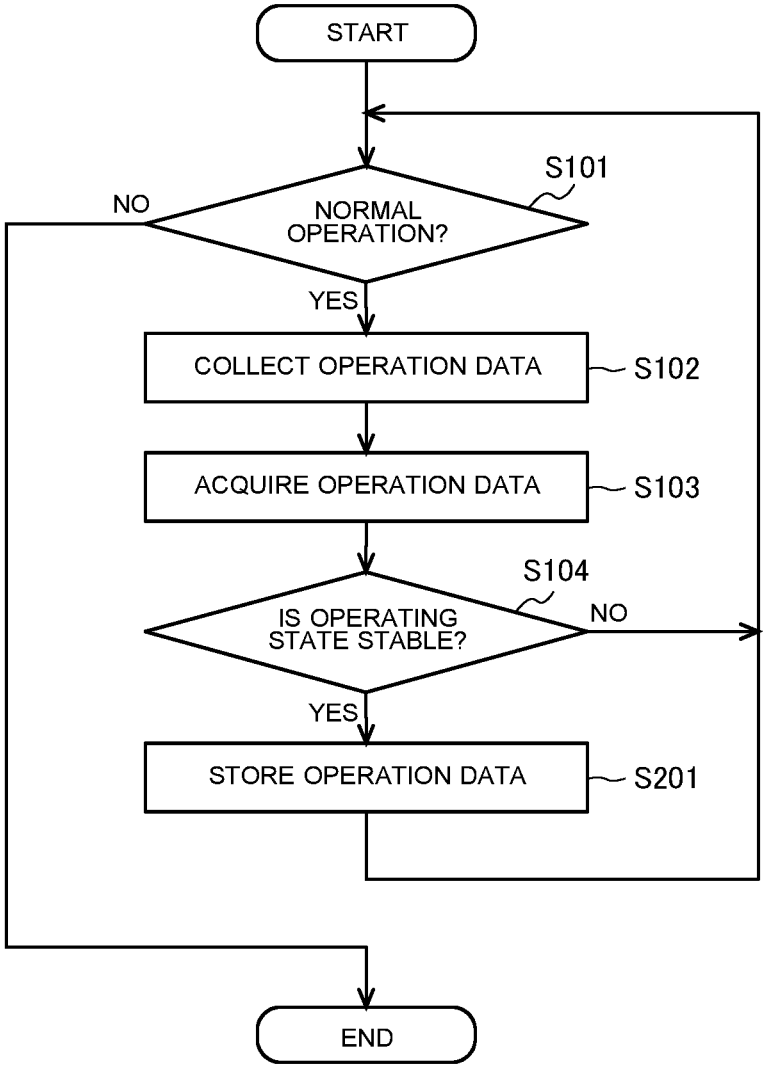
FIG. 7 is a flowchart illustrating an operation-data storing process included in the operation of a failure diagnosis system according to Embodiment 2 of the present invention.

FIG. 7 is a flowchart illustrating an operation-data storing process included in the operation of the failure diagnosis system according to Embodiment 2 of the present invention. The operation of the stable-operation determining unit 310 will be described with reference to FIG. 7. Steps identical to those in FIG. 6 will be given the same numbers, and descriptions thereof will be partially omitted.

First, the controller 140 determines whether or not the air-conditioning apparatus 100 is performing normal operation (step S101). If the controller 140 determines that the air-conditioning apparatus 100 is not performing normal operation (step S101/No), the failure diagnosis system 800 does not collect operation data at the current timing and terminates the operation-data storing process.

If the controller 140 determines that the air-conditioning apparatus 100 is performing normal operation (step S101/Yes), the controller 140 collects current operation data and transmits the current operation data to the stable-operation determining unit 310 (step S102). When the stable-operation determining unit 310 acquires the current operation data from the controller 140 (step S103), the stable-operation determining unit 310 uses the acquired operation data to determine whether or not the operating state of the air-conditioning apparatus 100 is stable (step S104).

If the stable-operation determining unit 310 determines that the operating state of the air-conditioning apparatus 100 is not stable (step S104/No), the failure diagnosis system 800 terminates the operation-data storing process at the current timing.

If the operating state of the air-conditioning apparatus 100 is stable (step S104/Yes), the stable-operation determining unit 310 causes the storage unit 320 to store the current operation data acquired from the controller 140 in step S103 as stable operation data (step S201).

The failure diagnosis system 800 executes the above-described series of steps including step S101 to step S104 and step S201 for every updating cycle. Therefore, the latest operation data during stable operation of the air-conditioning apparatus 100 is stored in the storage unit 320.

Figure 8:
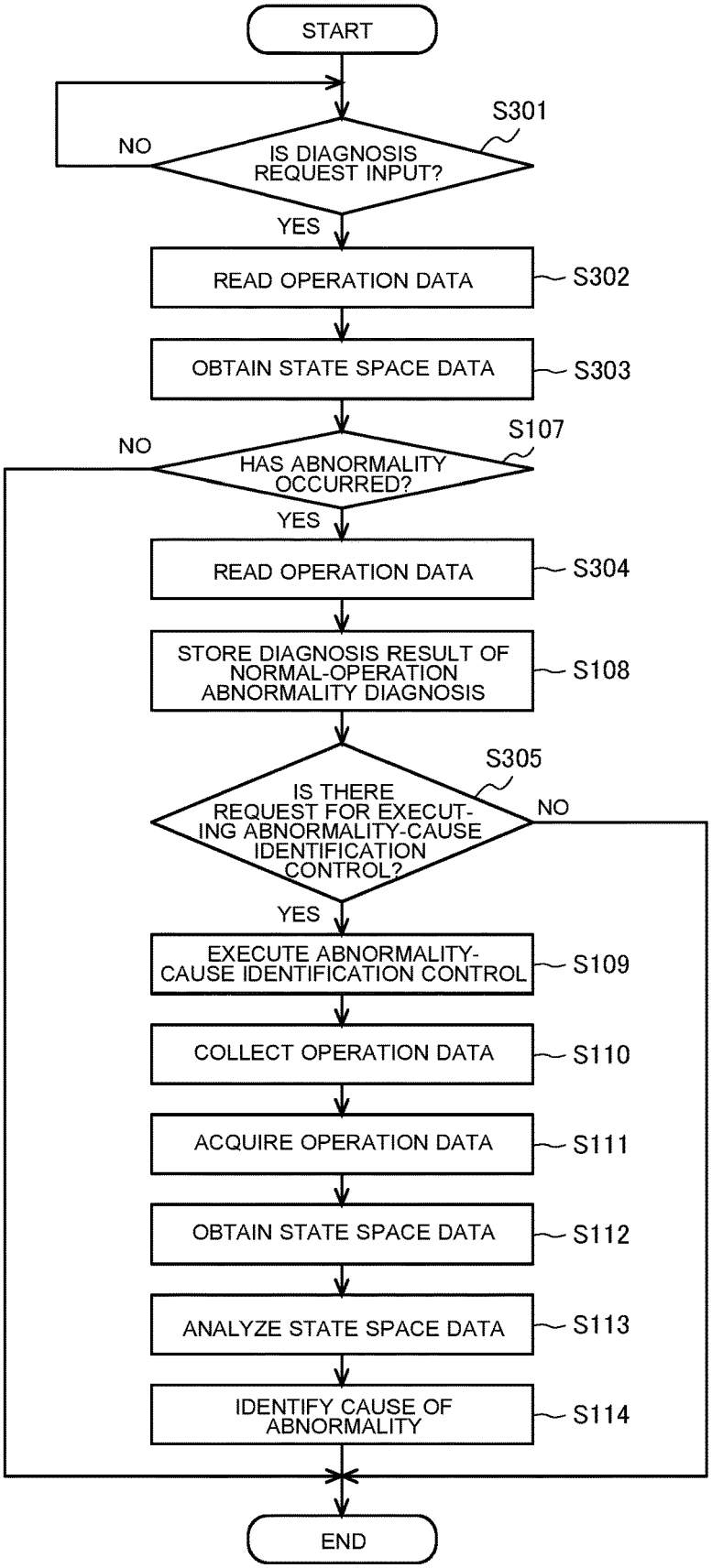
FIG. 8 is a flowchart illustrating the flow of failure diagnosis included in the operation of the failure diagnosis system according to Embodiment 2 of the present invention.

FIG. 8 is a flowchart illustrating the flow of failure diagnosis included in the operation of the failure diagnosis system according to Embodiment 2 of the present invention. The flow when a maintenance person uses the failure diagnosis system 800 by being commissioned by a client will be described with reference to FIG. 8.

First, the abnormality diagnosis unit 330 waits until a diagnosis request is input from the maintenance person via the management apparatus 400 or the information terminal 500 (step S301/No). When a diagnosis request is input via the management apparatus 400 or the information terminal 500 (step S301/Yes), the abnormality diagnosis unit 330 reads the latest stable operation data stored in the storage unit 320 (step S302).

The abnormality diagnosis unit 330 uses the read stable operation data to obtain state space data containing refrigerant state information x and a normal region X (step S303). Subsequently, the abnormality diagnosis unit 330 executes step S107, similar to the case in FIG. 6. The series of steps including step S301 to step S303 and step S107 corresponds to normal-operation abnormality diagnosis.

In a case where the abnormality diagnosis unit 330 determines that an abnormality has occurred in the air-conditioning apparatus 100 (step S107/Yes), the abnormality diagnosis unit 330 makes an inquiry to the maintenance person to ask whether or not failure-cause identification diagnosis is to be performed. Specifically, the abnormality diagnosis unit 330 transmits an output command for inquiring about whether or not the failure-cause identification diagnosis is to be performed to at least one of the management apparatus 400 and the information terminal 500. If the management apparatus 400 receives the output command from the abnormality diagnosis unit 330, the management apparatus 400 causes the display unit 421 to display information inquiring about whether or not the diagnosis is necessary. If the information terminal 500 receives the output command from the abnormality diagnosis unit 330, the information terminal 500 causes the display unit 521 to display information inquiring about whether or not the diagnosis is necessary (step S304). In addition, the abnormality diagnosis unit 330 executes step S108, similar to the case in FIG. 6.

Then, the abnormality diagnosis unit 330 waits until the maintenance person inputs a cause identification request via the management apparatus 400 or the information terminal 500. If the maintenance person performs an operation indicating that the abnormality-cause identification diagnosis is not necessary or if a predetermined waiting period elapses (step S305/No), the failure diagnosis system 800 terminates the failure diagnosis process.

On the other hand, when the maintenance person makes a request for the abnormality-cause identification diagnosis by inputting a cause identification request via the management apparatus 400 or the information terminal 500 (step S305/Yes), the process proceeds to step S109. Specifically, the failure diagnosis system 800 executes step S109 to step S114, similar to the case in FIG. 6. The series of steps including step S305 and step S109 to step S114 corresponds to abnormality-cause identification diagnosis.

If the abnormality diagnosis unit 330 determines that an abnormality has occurred in the air-conditioning apparatus 100 (step S107/Yes), the abnormality diagnosis unit 330 may cause at least one of the management apparatus 400 and the information terminal 500 to output the result of the normal-operation abnormality diagnosis together with the information inquiring about whether or not the diagnosis is necessary. Furthermore, in the above-described case (step S107/Yes), the abnormality diagnosis unit 330 may cause at least one of the management apparatus 400 and the information terminal 500 to display an analysis image based on the state space data obtained in step S303 together with the information inquiring about whether or not the diagnosis is necessary. Moreover, in the above-described case (step S107/Yes), the abnormality diagnosis unit 330 may cause at least one of the management apparatus 400 and the information terminal 500 to output the result of the normal-operation abnormality diagnosis and the analysis image based on the state space data obtained in step S303 together with the information inquiring about whether or not the diagnosis is necessary. Accordingly, the maintenance person can readily determine whether or not the abnormality-cause identification diagnosis is necessary, thereby achieving enhanced user-friendliness.

Accordingly, the failure diagnosis system 800 according to Embodiment 2 can achieve enhanced accuracy for determining whether or not there is an abnormality, and can also identify the cause of the abnormality quickly and accurately, thereby performing the failure diagnosis with high accuracy and high efficiency without impairing comfort. Moreover, the failure diagnosis system 800 according to Embodiment 2 causes the storage unit 320 or the storage unit 701 to accumulate, over time, the operation data acquired when the operating state of the air-conditioning apparatus 100 is determined as being stable by the stable-operation determining unit 310. The abnormality diagnosis unit 330 reads the latest operation data from the storage unit 320 or the storage unit 701 in response to a diagnosis request from the outside. Then, the abnormality diagnosis unit 330 uses the read operation data to determine whether or not there is an abnormality in the air-conditioning apparatus 100. Accordingly, when the maintenance person makes a diagnosis request, the normal-operation abnormality diagnosis can always be performed, thereby achieving enhanced user-friendliness. Other advantages are similar to those of Embodiment 1.

Embodiment 3

Figure 9:
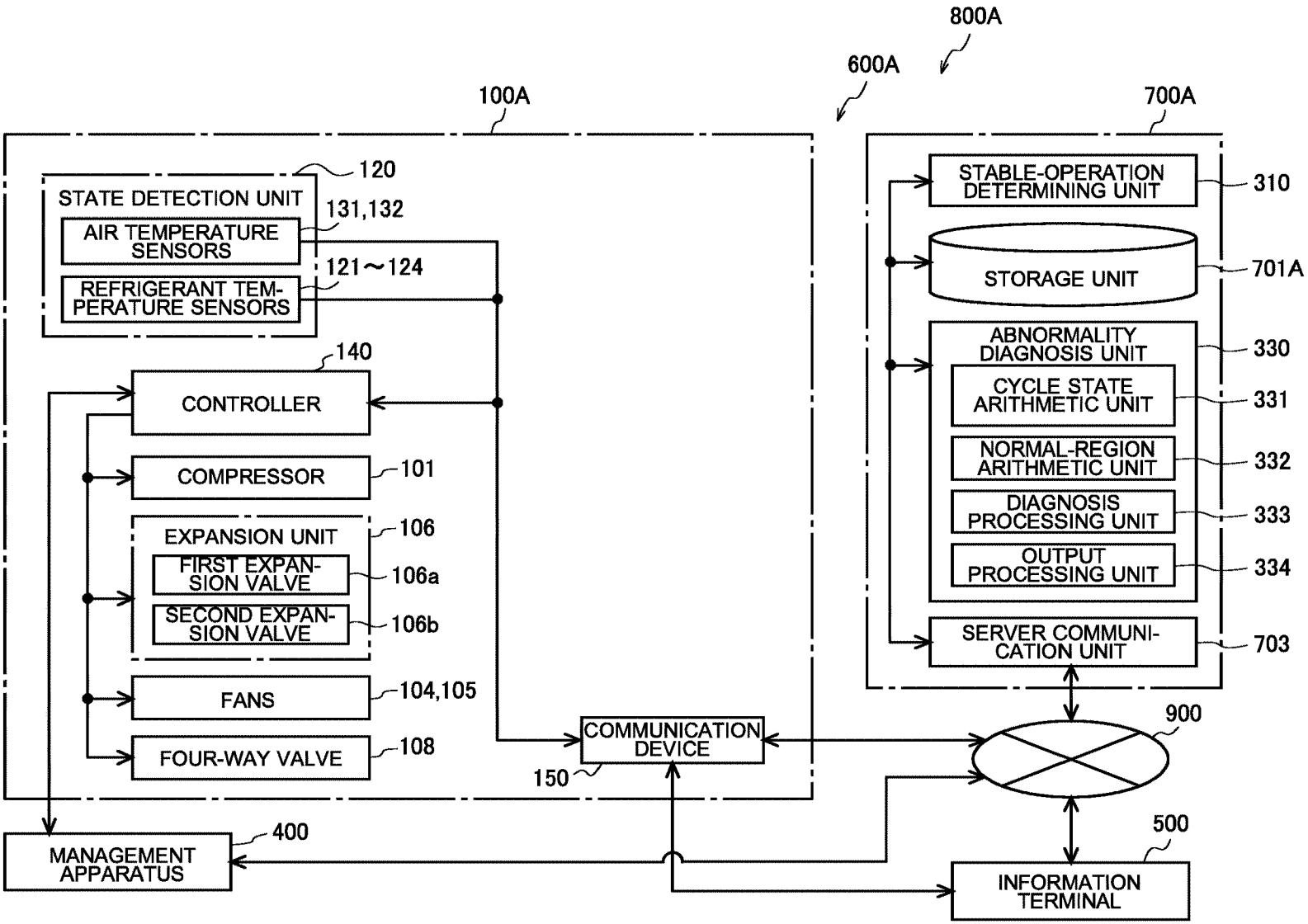
FIG. 9 is a block diagram illustrating a functional configuration of a failure diagnosis system according to Embodiment 3 of the present invention.

FIG. 9 is a block diagram illustrating a functional configuration of a failure diagnosis system according to Embodiment 3 of the present invention. Because the configuration of the failure diagnosis system according to Embodiment 3 is similar to those in Embodiment 1 and Embodiment 2, identical components will be given the same reference signs, and descriptions thereof will be omitted.

As illustrated in FIG. 9, a failure diagnosis system 800A includes an air-conditioning system 600A and a server apparatus 700A. The air-conditioning system 600A has an air-conditioning apparatus 100A, the management apparatus 400, and the information terminal 500. In the failure diagnosis system 800A, the stable-operation determining unit 310 and the abnormality diagnosis unit 330 are provided in the server apparatus 700A.

The server apparatus 700A comprises, for example, a storage processing apparatus provided outside the air-conditioning apparatus 100 and provided by a cloud service. The server apparatus 700A is connected to the management apparatus 400 and the information terminal 500 in a communicable manner via the electric communication line 900. The server apparatus 700A is connected to the controller 140 in a communicable manner via the electric communication line 900 and the communication device 150. Alternatively, the server apparatus 700A may be a physical server, such as a web server.

A storage unit 701A of the server apparatus 700A has the role of the storage unit 320 in Embodiment 1 and Embodiment 2 and the role of the storage unit 701 in Embodiment 1 and Embodiment 2. For example, various types of data included in signals sent from the controller 140, the refrigerant temperature sensors 121 to 125, and the air temperature sensors 131 and 132, state space data, and a diagnosis result obtained by the abnormality diagnosis unit 330 for a past certain period are stored in the storage unit 701A.

Furthermore, the abnormality diagnosis unit 330 according to Embodiment 3 has a function similar to that of the data processing unit 702 in Embodiment 1 and Embodiment 2. Although the path from which the stable-operation determining unit 310 and the abnormality diagnosis unit 330 acquire various types of data is different from the cases in Embodiment 1 and Embodiment 2, the configuration and the operation of the stable-operation determining unit 310 and the abnormality diagnosis unit 330 are similar to the cases in Embodiment 1 and Embodiment 2.

The failure diagnosis system 800A includes the server apparatus 700A and the single air-conditioning system 600A in FIG. 9, but is not limited to this configuration. The failure diagnosis system 800A may include the server apparatus 700A and a plurality of air-conditioning systems 600A. In this case, the abnormality diagnosis unit 330 may perform normal-operation abnormality diagnosis and abnormality-cause identification diagnosis for each of a plurality of air-conditioning apparatuses 100A.

Furthermore, the abnormality diagnosis unit 330 may cause the server apparatus 700A to accumulate, over time, the state data, the control data, the data obtained in the normal-operation abnormality diagnosis, and the data obtained in the abnormality-cause identification diagnosis for each air-conditioning apparatus 100A. Moreover, the abnormality diagnosis unit 330 may use the information accumulated in the server apparatus 700A for the normal-operation abnormality diagnosis and the abnormality-cause identification diagnosis with respect to each of the plurality of air-conditioning apparatus 100A. Accordingly, the diagnosis accuracy of the normal-operation abnormality diagnosis can be enhanced, similar to Embodiment 1 and Embodiment 2.

Accordingly, the failure diagnosis system 800A according to Embodiment 3 can achieve enhanced accuracy for determining whether or not there is an abnormality, and can also identify the cause of the abnormality quickly and accurately, thereby performing the failure diagnosis with high accuracy and high efficiency without impairing comfort. Furthermore, in the failure diagnosis system 800A, the stable-operation determining unit 310 and the abnormality diagnosis unit 330 are provided in the server apparatus 700A. Therefore, the abnormality diagnosis of the air-conditioning apparatus 100A can be performed accurately without having to add the stable-operation determining unit 310 and the abnormality diagnosis unit 330 inside the air-conditioning apparatus 100A. Specifically, even with an existing air-conditioning apparatus 100A, highly-accurate failure diagnosis can be performed by combining the apparatus with the server apparatus 700A. Other advantages are similar to those of Embodiment 1 and Embodiment 2.

Embodiment 1 to Embodiment 3 described above are preferred specific examples with respect to a failure diagnosis system, and the technical scope of the present invention is not to be limited to Embodiment 1 to Embodiment 3 described above. For example, as an alternative to the above description in which three specific locations are set as a specific example, the set number of specific locations may be one, two, or four or more.

Furthermore, the state detection unit 120 is not limited to the above-described configuration. For example, the state detection unit 120 may have a refrigerant temperature sensor that is provided at the suction side of the compressor 101 in place of the refrigerant temperature sensor 121 and that measures the temperature of refrigerant to be suctioned into the compressor 101. The sensors of the state detection unit 120 are not limited to temperature sensors. The state detection unit 120 may include a pressure sensor that measures the pressure of the refrigerant or an infrared camera that measures the temperature of a noncontact section.

Furthermore, the refrigerant circuit 200 is not limited to the configuration in FIG. 1. The air-conditioning apparatus 100 may be equipped with a refrigerant circuit 200 of various configurations. The failure diagnosis device 300 can analyze the state of the refrigerant circuit 200 having various configurations in a manner similar to the above. For example, as an alternative to the case in FIG. 1 where the expansion unit 106 includes the first expansion valve 106*a* and the second expansion valve 106*b*, the expansion unit 106 may be, for example, a single expansion valve formed of an electronic expansion valve.

Each of the failure diagnosis systems 800 and 800A according to Embodiment 1 to Embodiment 3 described above includes the management apparatus 400 and the information terminal 500, but is not limited to this configuration. The failure diagnosis systems 800 and 800A may each include either one of the management apparatus 400 and the information terminal 500. Furthermore, in a case where the air-conditioning apparatus 100 has, for example, a display unit and an input unit, each of the failure diagnosis systems 800 and 800A does not have to include the management apparatus 400 and the information terminal 500. In addition, the failure diagnosis system 800 according to Embodiment 1 and Embodiment 2 does not have to include the management apparatus 400 and the information terminal 500 if the failure diagnosis device 300 has, for example, a display unit and an input unit.

Moreover, the failure diagnosis system 800 according to Embodiment 1 and Embodiment 2 does not have to include the server apparatus 700.

REFERENCE SIGNS LIST

100, 100A air-conditioning apparatus 101 compressor 102 outdoor heat exchanger 103 indoor heat exchanger 104 outdoor fan 105 indoor fan 106 expansion unit 106*a* first expansion valve 106*b* second expansion valve 108 four-way valve 109 receiver 110 outdoor unit 111 indoor unit 120 state detection unit 121 to 125 refrigerant temperature sensors 131 and 132 air temperature sensors 140 controller 150 communication device 200 refrigerant circuit 300 failure diagnosis device 310 stable-operation determining unit 320 storage unit 330 abnormality diagnosis unit 331 cycle state arithmetic unit 332 normal-region arithmetic unit 333 diagnosis processing unit 334 output processing unit 400, 400C management apparatus 410, 510 input unit 420, 520 output unit 421, 521 display unit 422, 522 notifying unit 430, 530 output control unit 440 communication processing unit 500 information terminal 600, 600A air-conditioning system 700, 700A server apparatus 701, 701A storage unit 702 data processing unit 703 server communication unit 800, 800A failure diagnosis system 900 electric communication line A inlet region B outlet region C condenser region Cf refrigeration cycle pattern R refrigerant pipe S saturation line Tin, Tout isothermal line X normal region a inlet information b outlet information c condenser information x refrigerant state information

The invention claimed is:

1. A failure diagnosis system configured to diagnose a state of an air-conditioning apparatus having a refrigerant circuit in which refrigerant circulates, the failure diagnosis system comprising:

a state detection sensor configured to detect a state of the refrigerant in the refrigerant circuit as state data;

a controller configured to control an actuator of the air-conditioning apparatus;

a processor, and the processor being configured to perform normal-operation abnormality diagnosis determining presence or absence of abnormality of the air-conditioning apparatus by using the state data, and control data indicating a content of control by the controller during a normal operation of the air-conditioning apparatus, the processor being configured to, when determining that abnormality is present in the air-conditioning apparatus, change a control value of the actuator of the air-conditioning apparatus, acquire the state data and the control data, and perform abnormality-cause identification diagnosis identifying a cause of an abnormality of the air-conditioning apparatus by using the state data and the control data that are acquired before the change of the control value of the actuator, and the state data and the control data that are acquired after the change of the control value of the actuator, wherein the processor is configured to obtain refrigerant state information, indicating the state of the refrigerant at a specific location of the refrigerant circuit, by using the state data and the control data in the normal-operation abnormality diagnosis, and obtain the refrigerant state information by using the state data and the control data after the change of the control value of the actuator and compare the obtained refrigerant state information with the refrigerant state information obtained in the normal-operation abnormality diagnosis to identify the cause of the abnormality in the air-conditioning apparatus in the abnormality-cause identification diagnosis, wherein the processor is configured to cause a management apparatus to display the refrigerant state information obtained in the normal-operation abnormality diagnosis and the refrigerant state information acquired after the change of the control value of the actuator, the management apparatus being configured to manage the air-conditioning apparatus.

2. A failure diagnosis system configured to diagnose a state of an air-conditioning apparatus having a refrigerant circuit in which refrigerant circulates, the failure diagnosis system comprising:

a state detection sensor configured to detect a state of the refrigerant in the refrigerant circuit as state data;

a controller configured to control an actuator of the air-conditioning apparatus;

a processor, and the processor being configured to perform normal-operation abnormality diagnosis determining presence or absence of abnormality of the air-conditioning apparatus by using the state data, and control data indicating a content of control by the controller during a normal operation of the air-conditioning apparatus, the processor being configured to, when determining that abnormality is present in the air-conditioning apparatus, change a control value of the actuator of the air-conditioning apparatus, acquire the state data and the control data, and perform abnormality-cause identification diagnosis identifying a cause of an abnormality of the air-conditioning apparatus by using the state data and the control data that are acquired before the change of the control value of the actuator, and the state data and the control data that are acquired after the change of the control value of the actuator, wherein the processor is configured to obtain refrigerant state information, indicating the state of the refrigerant at a specific location of the refrigerant circuit, by using the state data and the control data in the normal-operation abnormality diagnosis, and obtain the refrigerant state information by using the state data and the control data after the change of the control value of the actuator and compare the obtained refrigerant state information with the refrigerant state information obtained in the normal-operation abnormality diagnosis to identify the cause of the abnormality in the air-conditioning apparatus in the abnormality-cause identification diagnosis, further comprising a communication device serving as an interface when the processor communicates with an external device, wherein the processor is configured to cause an information terminal connected via the communication device to display the refrigerant state information obtained in the normal-operation abnormality diagnosis and the refrigerant state information acquired after the change of the control value of the actuator.

* * * * *